United States Patent [19]

Schwegman, deceased

[11] 4,294,313

[45] Oct. 13, 1981

[54] KICKOVER TOOL

[75] Inventor: Harry E. Schwegman, deceased, late of Dallas County, Tex., by M. J. Whitfield for First National Bank in Dallas, executor

[73] Assignee: Otis Engineering Corporation, Dallas, Tex.

[21] Appl. No.: 490,557

[22] Filed: Jul. 24, 1974

Related U.S. Application Data

[63] Continuation-in-part of Ser. No. 384,520, Aug. 1, 1973, abandoned.

[51] Int. Cl.[3] ..... E21B 43/12

[52] U.S. Cl. ..... 166/117.5

[58] Field of Search ..... 166/117.5, 117.6; 417/109

[56] References Cited

U.S. PATENT DOCUMENTS

| | | | |
|---|---|---|---|
| 3,353,608 | 11/1967 | Beebe et al. | 166/117.5 |
| 3,610,336 | 10/1971 | Sizer | 166/156 |
| 3,732,928 | 5/1973 | Sizer | 166/315 |
| 3,788,397 | 1/1974 | Terral et al. | 166/117.5 |
| 3,827,489 | 6/1974 | McGowen, Jr. | 166/117.5 |
| 3,827,490 | 8/1974 | Moore, Jr. et al. | 166/117.5 |
| 3,837,398 | 9/1974 | Yonker | 166/117.5 |

*Primary Examiner*—James A. Leppink

*Attorney, Agent, or Firm*—Albert W. Carroll; M. H. Gay

[57] ABSTRACT

A kickover tool for installing devices such as gas lift valves in and removing them from the offset side pocket receptacles of side pocket mandrels in wells. Kickover movement of the device carrying means from a longitudinally aligned, running-in position to a laterally offset position for landing or pulling the device is controlled by means actuable by engagement with a shoulder in the well flow conductor during upward movement of the kickover tool. Means for positively locking the device carrying means in the laterally offset or kickover position are disclosed, these means being automatically releasable upon withdrawal of the kickover tool from the side pocket mandrel.

74 Claims, 19 Drawing Figures

16
55
24a
56
57
24b
65
43b
53
43a
58
53b
43
24c
54
53a
21
21
53c
53
68
44
63b
53d
64
63
63a
37
36
62
45
24
66
67
67
26a
26
25

37
25
42
27
41
38
41a
28p
28a
39a
39
28b
6
6
46
22a
22c
28
22b
22f
39b
22
47a
22d
22e
47b
48
29
47
47a
69
51
49
71
12

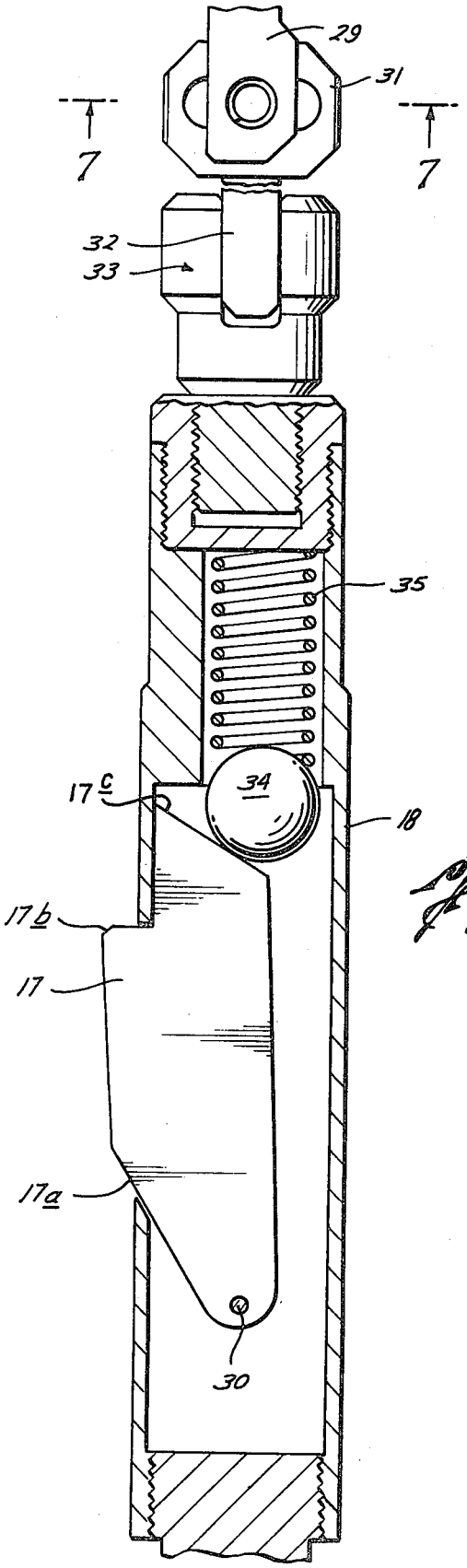
Fig. 5C
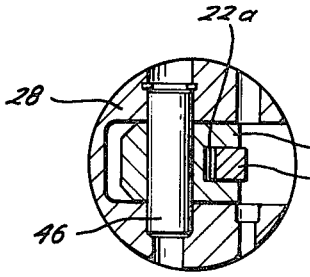
Fig. 6
Fig. 7
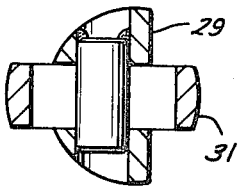
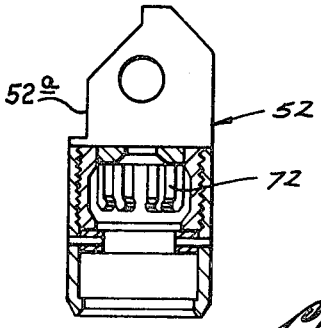
Fig. 11

KICKOVER TOOL

This application is a continuation-in-part of application Ser. No. 384,520, now abandoned, entitled KICKOVER TOOL filed Aug. 1, 1973.

This invention relates to kickover tools and more particularly to kickover tools for installing devices such as gas lift valves in or removing them from side pocket mandrels and further relates to a kickover tool which may be run on either a wireline or by utilizing pump down equipment.

With the advent of the side pocket mandrel numerous forms of kickover tools have been suggested for landing and retrieving tools such as gas lift valves in side pocket mandrels. See U.S. Pat. Nos. 2,679,903; 2,664,162; 2,679,904; 2,988,146; 3,353,608; 2,828,698; 2,942,671; 2,948,341; 3,353,607, 3,610,336; 2,959,227; 2,964,110; 3,075,586; 3,732,928. While some of the structures exemplified by the above patents have enjoyed commercial success, only the structure shown in patent 3,610,336 is usable in pump down equipment and this use is limited to operations wherein the tools are not required to negotiate short radius bends in the flow conduit as they would be required to do in conventional through-flowline (TFL) operations. The design of such prior art tools has been such that the tools tend to bind and operate at reduced efficiency because force applied in the setting and pulling of devices is not applied along the longitudinal axis of the device being run or pulled. The forces available to kick the pivot arm into the kickover or laterally offset position are in some instances insufficient to accomplish this objective in wells whose bores are substantially deviated from the vertical. Relatively high forces are involved in pump down operations and only the kickover tool of patent 3,610,336 utilizes multiple lugs which are capable of withstanding these forces without substantial damage to the lugs or to the shoulders in the well tubing with which they engage.

It is an object of this invention to provide a simple, dependable kickover tool useful in either wireline or pump down operations.

Another object of this invention is to provide such a kickover tool which will pass short radius bends in the flow conduit, for instance, in through-flowline (TFL) operations.

Another object is to provide a kickover tool wherein a single shoulder in the well tubing is utilized to operate the kickover tool in either wireline or pump down operations.

Another object is to provide a kickover tool for wireline or pump down operations wherein a device carried thereby is swingable laterally outwardly to an offset position by relative longitudinal movement of telescoping parts, which arrangement permits a strong spring force to be used, thus insuring that the device is moved to its full offset position even in highly deviated wells.

Another object is to provide a kickover tool for wireline or pump down operations in which a device carried thereby and to be installed in or removed from a side pocket is held laterally offset and approximately parallel to the kickover tool during landing or pulling operations to avoid binding forces between the device and side pocket.

Another object is to provide a kickover tool for wireline or pump down operations having a longitudinally movable sleeve thereon having means engageable with a shoulder in the tubing and movable between multiple positions for controlling the operation of the tool.

Another object is to provide a kickover tool for wireline or pump down operations in which a multiple position operator sleeve having multiple lugs for engaging a single shoulder in a well controls the operation of the tool and the lugs can readily pass such shoulders going into the well, but when the kickover tool encounters such shoulder in its upward travel in the well tubing, the device carried by the kickover tool will be caused to kickover into position for landing such device in or pulling it from the side pocket, and when such shoulder is again encountered and a larger force is applied to lift the kickover tool, such lugs will retract to permit retrieval of the kickover tool from the well.

Another object is to provide a kickover tool for wireline or pump down operations in which the tool will exert a straight up or down force on devices being landed in or pulled from the side pocket mandrel, thus avoiding side loads and damage to tools or the internal surface of the side pocket.

A further object of this invention is to provide a kickover tool of the character described wherein the kickover portion of the tool is positively latched in kickover position so that forces applied therethrough to a device to withdraw it from the side pocket receptacle will be applied along the longitudinal axis thereof without binding due to undesirable side forces even though the device offers substantial resistance to such axial forces.

Another object is to provide a kickover tool of the character just described wherein the means for latching its kickover portion in kicked over or laterally offset position are releasable upon application of a longitudinal force sufficient to withdraw the kickover tool from the side pocket mandrel.

Another object is to provide a kickover tool having means for holding and latching its kickover portion in kicked over or laterally offset position, such latching means comprising one or more shear pins which are movable into position to latch the kickover portion in kicked over position automatically when the kickover portion reaches the kicked over position.

Another object is to provide a kickover tool of the character just described wherein the one or more shear pins will be sheared automatically when the kickover portion is forced from its kicked over position during withdrawal of the kickover tool through the upper end of the side pocket mandrel.

Another object is to provide a kickover tool which is adapted to install a device such as a gas lift valve in or to remove such a device from the side pocket receptacle of a selected one of a plurality of identical side pocket mandrels in a well tubing.

A further object is to provide a kickover tool, two of which can be connected together and run into the well in tandem, one of such kickover tools being adapted to extract a device from the side pocket of a selected mandrel and the other such kickover tool being adapted to install a replacement device in the just vacated side pocket in a single trip of the tandem kickover tools into the well.

Other objects, features and advantages of the invention will be apparent from studying the specification, the drawings, and the claims.

In the drawings wherein like numerals indicate like parts and wherein illustrative embodiments of this invention are shown;

Figure 4:
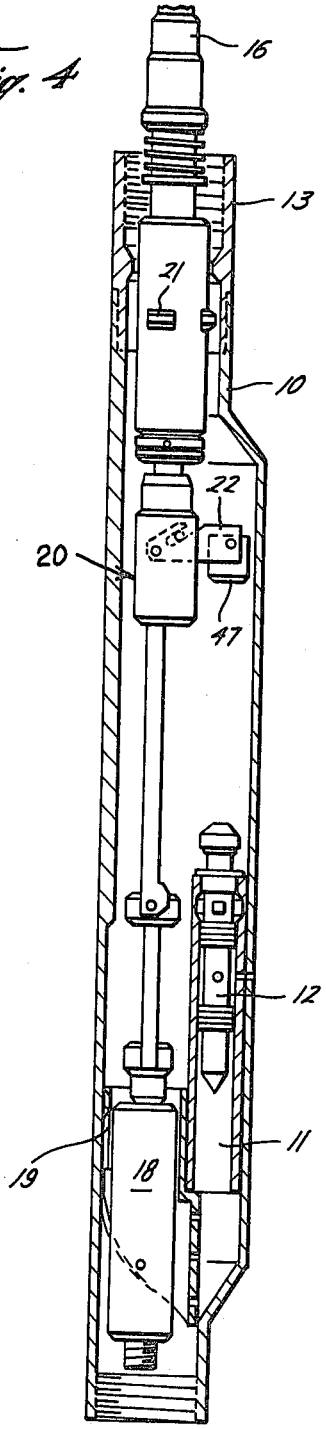
FIG. 4 is a view similar to FIGS. 1, 2 and 3 showing the kickover tool disengaged from the drive which is landed in the side pocket.
Figure 5A:
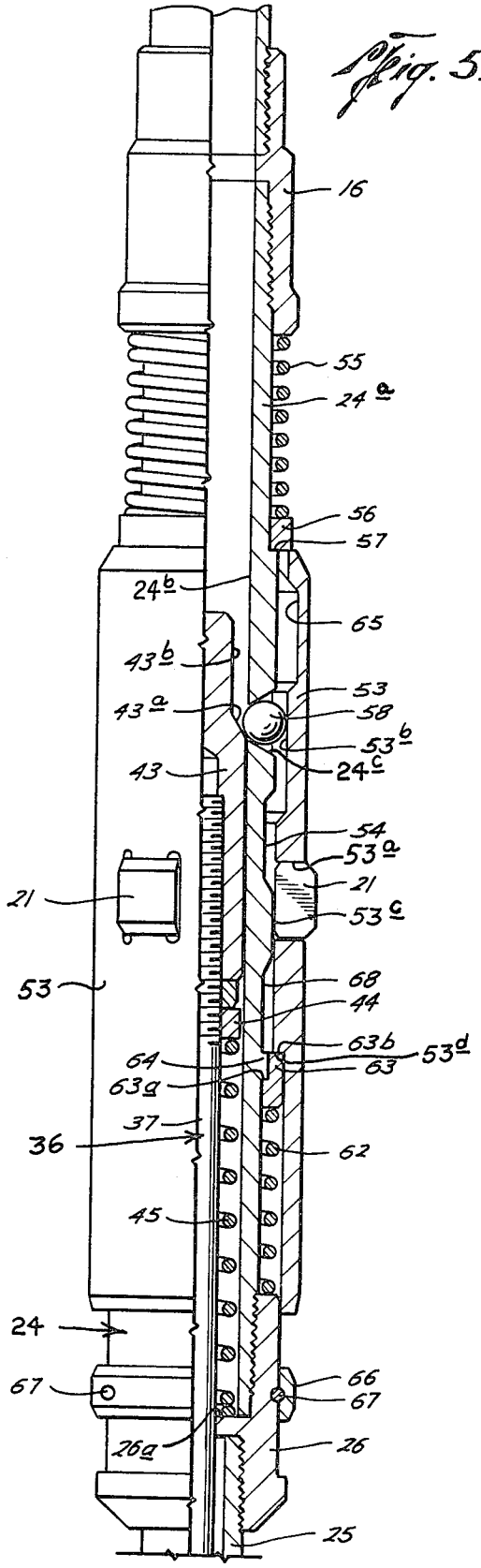
Figure 5B:
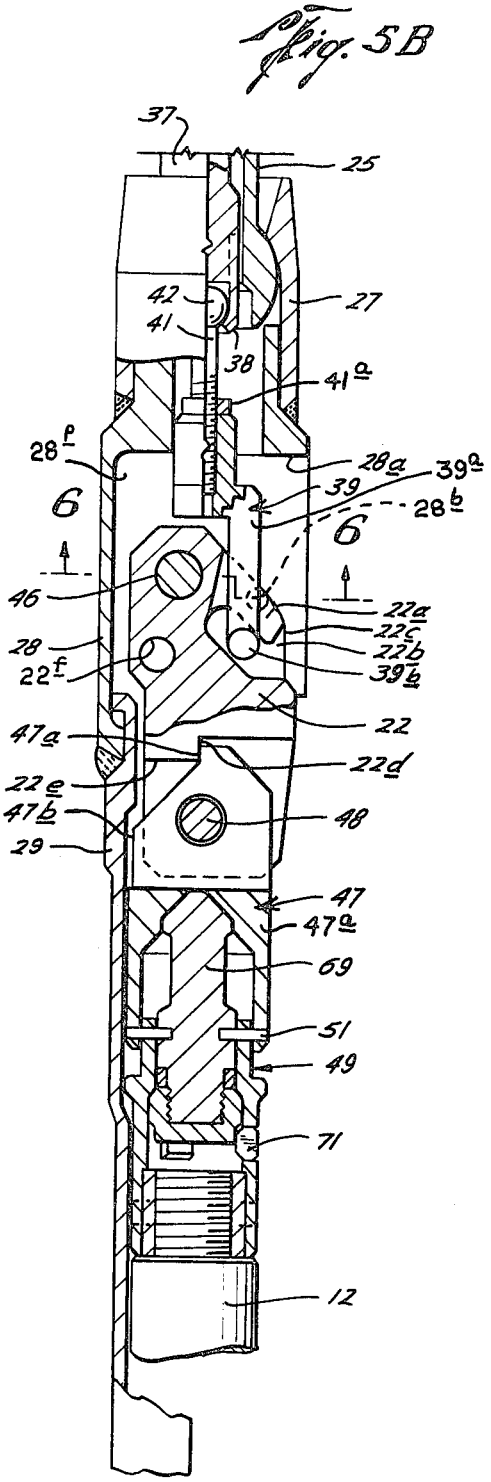
Figure 8:
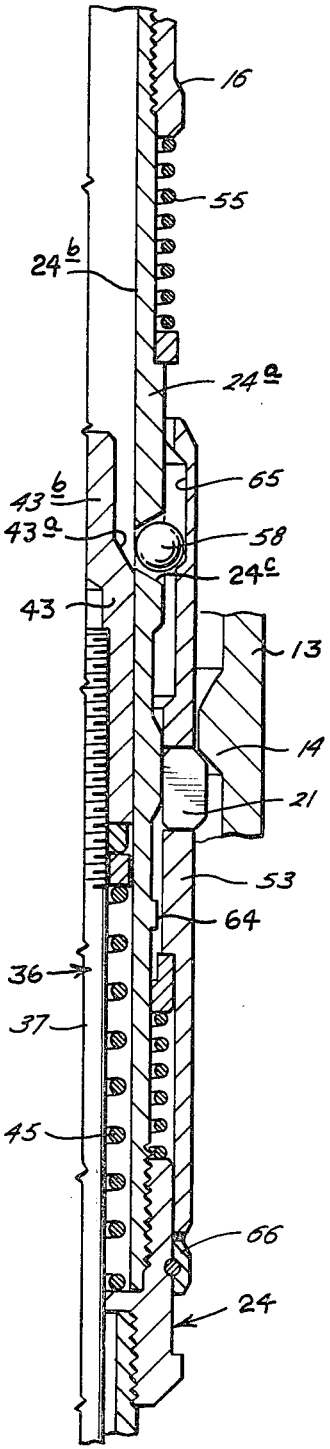
Figure 9:
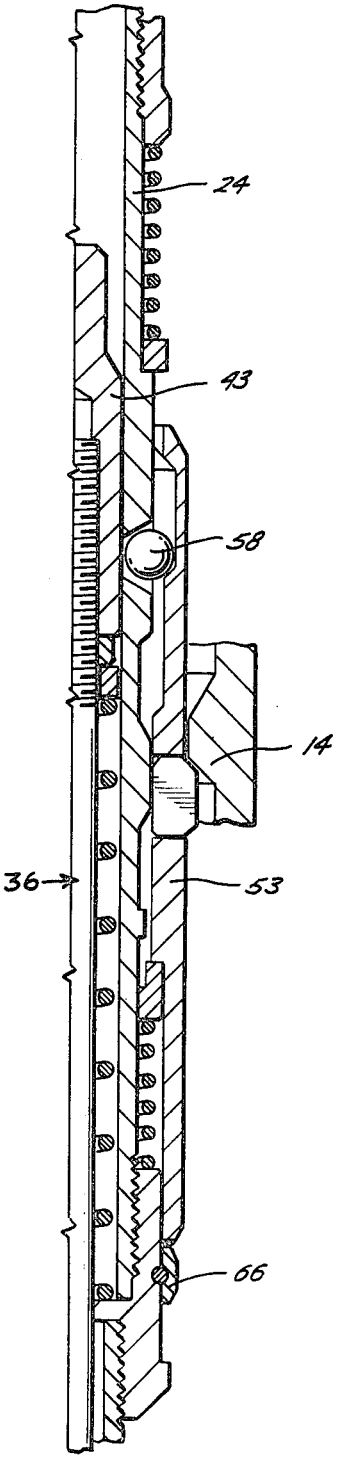
Figure 10:
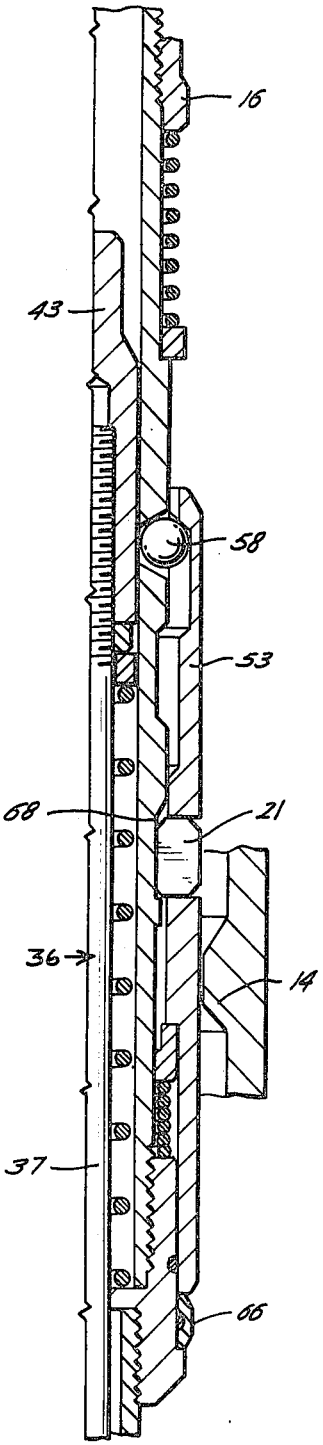
Figure 13:
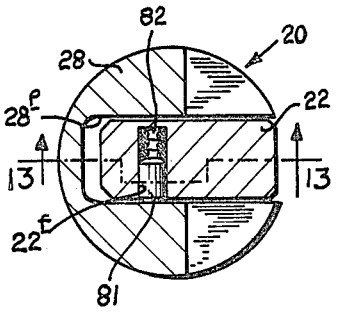
Figure 12:
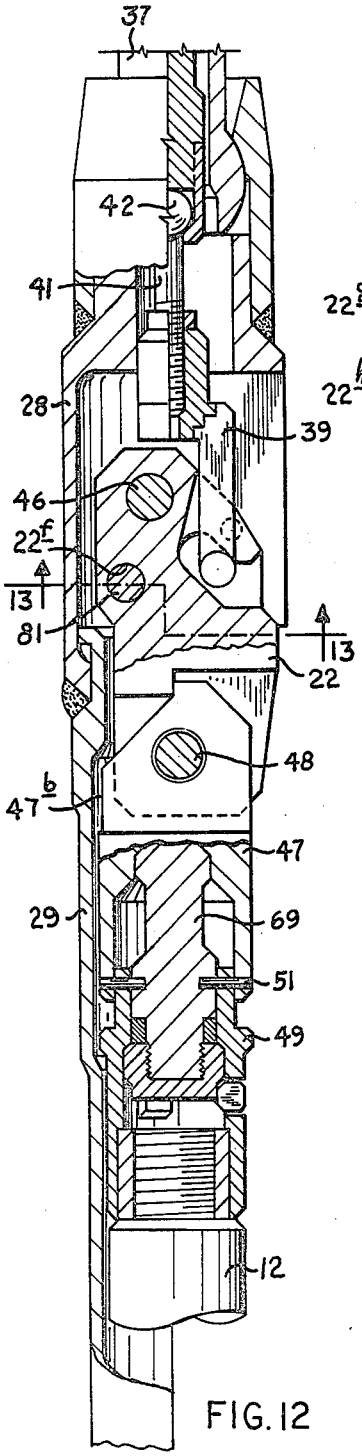
Figure 17:
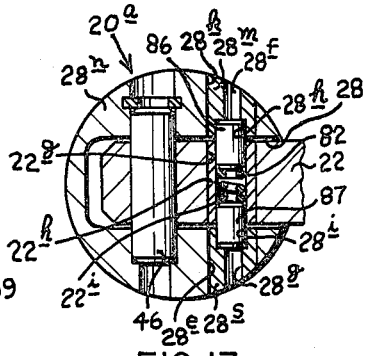
Figure 14:
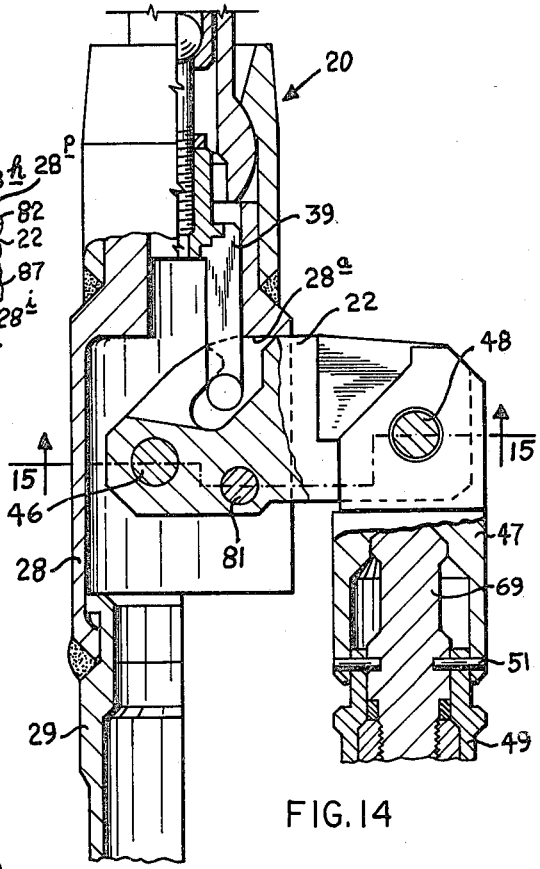
Figure 16:
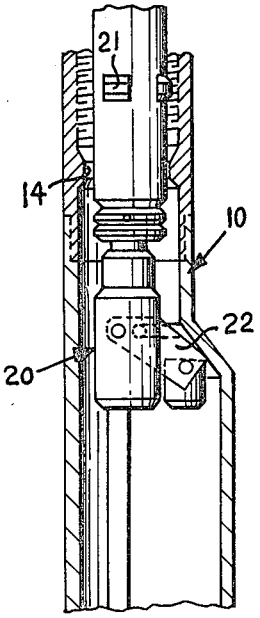
Figure 15:
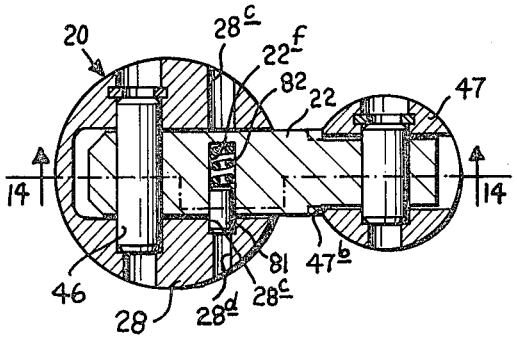

FIGS. 5A, 5B, and 5C are continuation views, partially in elevation and partially in section which taken together show a kickover tool constructed in accordance with this invention;

FIG. 6 is a cross-sectional view taken along line 6—6 of 5B;

FIG. 7 is a cross-sectional view taken along line 7—7 of 5C;

FIGS. 8, 9 and 10 are fragmentary sectional views showing different positions of the various parts of the control section of the kickover tool;

FIG. 11 is a longitudinal sectional view showing a form of retrieval or pulling tool for use with the kickover tool for retrieving a device from a side pocket mandrel in a well;

FIG. 12 is a view similar to FIG. 5B showing the device of FIG. 5B provided with shear pin means for locking the device carrier in kickover position;

FIG. 13 is a cross-sectional view taken along line 13—13 of FIG. 12;

FIG. 14 is a view similar to FIG. 12 but showing the device carrier latched in kickover position;

FIG. 15 is a cross-sectional view taken along line 15—15 of FIG. 14;

FIG. 16 is a fragmentary view similar to FIG. 4 showing the device carrier being retracted as the kickover tool is being withdrawn from the side pocket mandrel; and FIG. 17 is a fragmentary cross-sectional view similar to FIG. 15 showing a kickover tool which has been modified to accept two shear pins for latching the device carrier in kickover position.

The side pocket mandrel is indicated generally by the numeral 10 and is adapted to be made up in a tubing string in the conventional manner to become a part thereof. The mandrel includes a side pocket 11 for receiving a flow control device such as a gas lift valve 12. The bore 11*a* of the side pocket is offset from and substantially parallel to the longitudinal axis of the tubing bore. At the upper end of the mandrel a locator sub 13 is provided having an internal locator flange or shoulder 14 with which the kickover tool 20 cooperates to control the kickover function as will be hereinafter explained. At the lower end of the mandrel, and below the side pocket 11, an orienting shoe 15 having a slot 19 extending longitudinally therein, as shown is provided for orienting the entire kickover tool such that the gas lift valve 12 to be installed in the side pocket is aligned therewith. After the kickover tool is actuated, the valve 12 is kicked over to a laterally offset position wherein it is in longitudinal axial alignment with the side pocket bore.

Reference is made to the above identified patents, and particularly to U.S. Pat. No. 3,610,336 for an explanation of the manner in which kickover tools are run both on wirelines and with pump down equipment. In the case of wireline operations, the wireline and tool string including a set of jars are attached to the upper sub 16 and in the case of pump down equipment the pump down tool train including at least one locomotive or piston is attached to the sub 16. A set of jars may also be included in the pump down tool string if desired although they are not normally required since the pumped fluid acting against the piston generates forces of sufficient magnitude for almost all work. For instance, a pressure differential of 2000 psi across a piston having an area of 3.13 square inches generates a thrust of 6260 pounds. The forces applied are substantially larger in the case of pump down operation than with wireline operation. Also, with pump down operation, it is preferred that the kickover tool be able to negotiate a short radius turn in the well conduit and, as will appear hereinafter, the kickover tool of this invention is capable of articulating at desired points spaced along its length to permit it to negotiate such short radius turns in the pipe. In wireline operations such turns are not encountered and the articulating joints may be dispensed with if desired.

Figure 1:
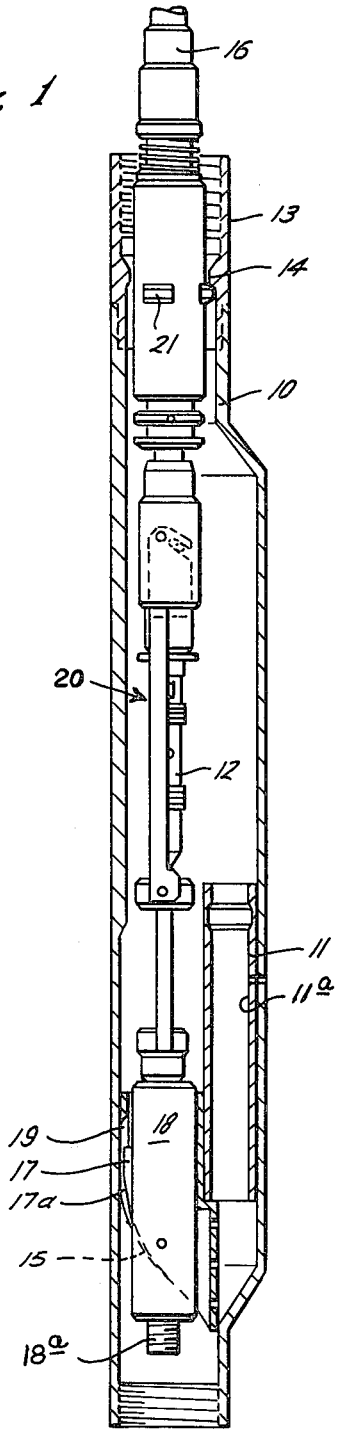
FIG. 1 is a longitudinal sectional view showing the kickover tool in elevation with the parts thereof in running relationship.

In the general operation of the kickover tool 20 as shown in FIGS. 1 through 4, the kickover tool is run past the position shown in FIG. 1 to assure that the orienting key 17 in the orienting housing 18 travels to a position below the orienting shoe 15. Then upon upward movement of the kickover tool, the key 17 will engage the orienting shoe 15 to rotate the kickover tool about its vertical axis to proper orientation with respect to the side pocket, at which time the orienting key 17 will be within longitudinally extending slot 19 in the orienting shoe as shown in FIG. 1. The slot 19 may or may not extend the full length of the orienting shoe.

Figure 2:
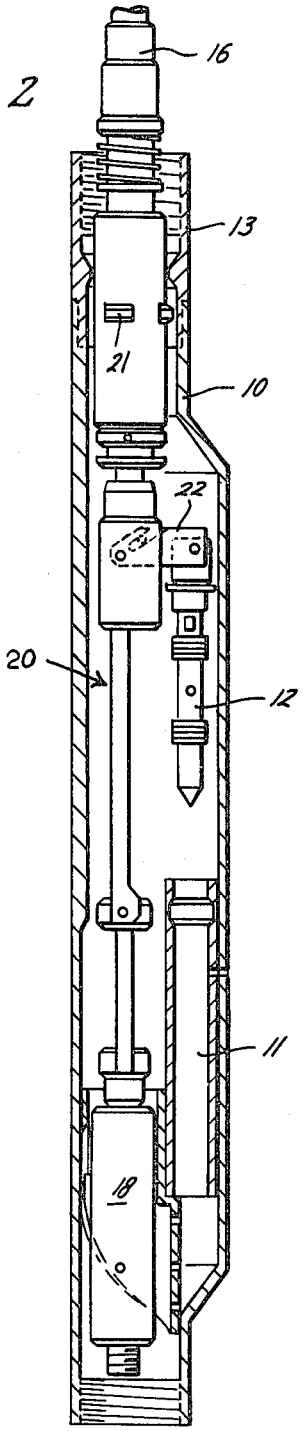
FIG. 2 is a view similar to FIG. 1 showing the device carrier in position to land a device such as a flow control device in the side pocket.
Figure 3:
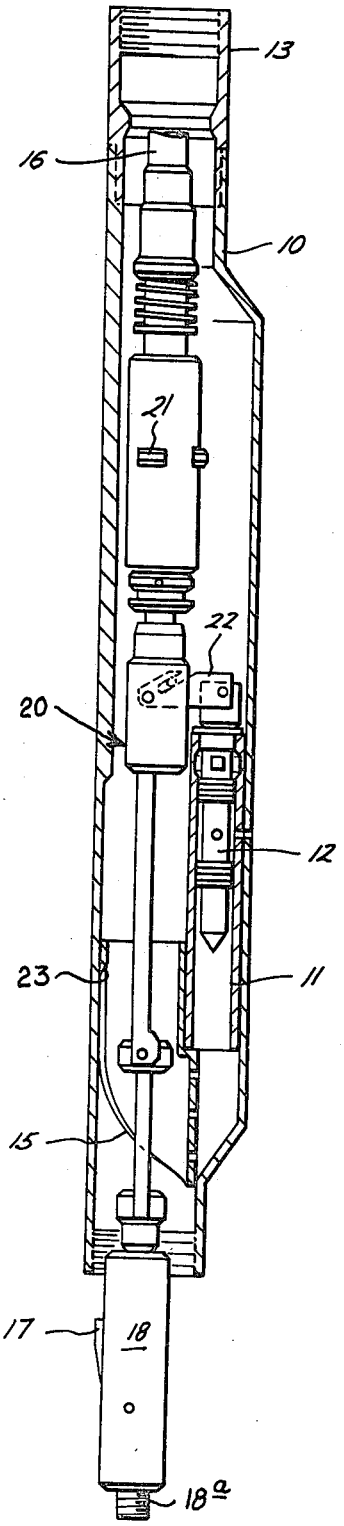
FIG. 3 is a view similar to FIGS. 1 and 2 showing the device landed in the side pocket.

Further upward movement of the kickover tool moves the lugs 21 into engagement with the locating shoulder 14. Still further upward movement results in the kickover tool operating in a manner to be hereinafter more fully described to kickover or swing the arm 22 from a position of longitudinal alignment within the kickover tool to a kickover position in which it extends outwardly of the kickover tool, in which position the gas lift valve 12 releasably secured thereto is in substantial axial alignment with the bore of the side pocket 11 as is seen in FIG. 2. When the pivot arm is in its kickover position it is disposed at about 90 degrees to the longitudinal axis of the kickover tool. It is conceivable that the kickover tool could be designed such that this angular displacement might be substantially less than the 90 degrees illustrated in the drawing. Downward movement of the kickover tool then inserts and seats the valve 12 in the side pocket 11 as shown in FIG. 3. The kickover tool may then be withdrawn from the well, and in FIG. 4 the kickover tool is shown in the initial stages of its upward travel. It should be noted that the top of the orienting shoe slot 19 is chamfered as at 23 to depress the orienting key 17 and permit its upward passage through the orienting shoe. It will be noted that the locator shoulder 14 is also chamfered so that the key 17 will likewise readily move therepast. The lower surface 17*a* of key 17 is inclined at a small angle to the vertical so that the key will be depressed by both the locator shoulder 14 and the orienting shoe in running the kickover tool into the well.

It should be understood that, although well bores are sometimes deviated from the vertical to such a great degree that a portion thereof may approach the horizontal, they are usually thought of as being substantially vertically disposed in the earth. Accordingly, well tools are thought of as being lowerable into wells where they move downwardly through the well bore or conduit toward the bottom of the well and are later lifted or returned to the surface by applying an upward force thereto thereby moving them upwardly in the well. Therefore, although a well tool may be disposed for a time in such horizontal portion of the well bore or conduit, it is still understood that lifting the tool in such case will return it to the surface of the well or toward the well head and, conversely, lowering of the tool will cause it to move toward the bottom of the well or downwardly in the well bore or conduit.

The construction of the tool is shown in FIGS. 5 through 7. The elongate main body or housing 24 of the kickover tool 20 includes the upper housing member 24*a* which depends from the coupling 16, a swivel attachment 25 secured to the upper housing member 24*a* by shear sub or coupling 26, a swivel socket 27 and a pivot housing 28 which is welded to the lower end of the socket 27.

A housing extension or guide 29 extends downwardly from the main body or housing 24 for partially housing the valve 12 and guiding it past side pockets in the well tubing and also provides a means for generally aligning the kickover tool within the side pocket mandrel. A first non-swiveling articulated joint 31 connects the bottom of guide 29 to the upper end of the spacer member 32 while the lower end of the spacer member 32 is connected by a second non-swiveling articulated joint 33 to the upper end of the orienting housing 18.

In order to orient the kickover tool into the proper relationship with the side pocket 11 of the side pocket mandrel, an orienting means is provided. Such orienting means includes the housing 18 in which the orienting key 17 is releasably secured by shear pin 30. The shear pin 30 acts as a pivot to permit the key to be depressed as the surface 17*a* thereof moves downwardly past shoulders within the tubing, or as the chamfer 17*b* at its upper end moves upwardly past shoulders such as the chamfer 23 at the upper end of the orienting slot or the locating shoulder 14.

In the event that the key lodges anywhere in the well tubing, the pivot pin 30 will shear and permit the key 17 to drop to a non-interfering position inside the housing 18. The key 17 is urged outwardly by the ball 34 which is biased downwardly against the key's upper beveled end 17*c* by compression spring 35.

An actuator mandrel assembly 36 is arranged in telescopic relationship with the main housing 24. The relative position between the actuator mandrel assembly and the main housing controls pivoting of the pivot arm 22 as will be explained. Preferably, the main housing has a bore 24*b* therethrough and the actuator mandrel assembly is telescopically or slidably received therewithin. The actuator mandrel assembly includes the actuator rod 37 which has a socket 38 at its lower end to which the crank arm 39 is attached by an adjusting stud 41 having a ball 42 on its upper end disposed in the socket 38. The adjustment of the crank arm is preserved by providing a suitable lock nut 41*a* on the stud which is tightened against the upper end of the crank arm as shown in FIG. 5B. At its upper end, the actuator mandrel assembly 36 includes an actuator mandrel member 43 which is threaded to the upper end of rod 37 and secured by lock nut 44. The upper end of the actuator mandrel 43 is formed with a reduced diameter 43*a* providing an inclined upwardly facing shoulder 43*b* for purposes which will be made clear hereinafter.

The actuator mandrel assembly 36 is urged in a direction away from the pivot housing 28 by resilient means such as spring 45 which is held under compression between an internal shoulder 26*a* within the shear sub 26 and the lock nut 44 on the actuator rod 37.

The pivot arm is pivotally mounted on one and is connected to the other of the elongate housing 24 and the actuator mandrel assembly 36 in such manner that the pivot arm is pivotable upon relative movement between the housing and the actuator mandrel assembly. Preferably, the pivot arm 22 is mounted in slot 28*p* in the pivot housing 28 by a pivot pin 46. The pivot arm is swingable between a first retracted position wherein it is disposed in longitudinal alignment with the elongate housing 24 and a second extended or kickover position wherein it extends laterally outwardly of the housing. Device attachment means such as the running tool 47 or the pulling tool 52 is hingedly attached to the pivot arm by pin 48. When the pivot arm is pivoted, it is swung laterally outwardly of the slot 28*p* to its kickover position and the running tool 47 is pivoted in the opposite direction about pin 48 so that it is disposed offset from the housing and parallel thereto and in axial alignment with the side pocket as seen in FIG. 2.

The actuator mandrel assembly 36 is slidably mounted in the housing and is movable between a lower position shown in FIGS. 5A and 5B and an upper position shown in FIG. 14. The actuator mandrel assembly is connected to the pivot arm means 22 by the crank arm 39. The lower portion or shank 39*a* of the crank arm extends down into the T-slot 22*a* formed in the pivot arm. A T-head 39*b* formed on the lower end of the crank arm shank is engaged in the lateral portions 22*b* of the T-slot of the pivot arm. Upon movement of the actuator mandrel assembly from its lower to its upper position, the crank arm will move the pivot arm about its pivot pin 46 from its retracted to its extended position.

In order to provide for a solid metal-to-metal engagement or connection between the housing 24 and the pivot arm 22 when installing the valve 12 in the side pocket 11, the actuator mandrel assembly is movable upwardly relatively to the housing a sufficient distance to bring the surface 22*c* on the pivot arm 22 into abutment with the upper end surface 28*a* of the slot 28*p* in the pivot housing 28. Thus, when a downward force is applied to the kickover tool, the pivot arm 22, after it has been moved to kickover position, will be maintained in such position and will transmit this downward force in a direction aligned with the longitudinal axis of the valve and the side pocket.

During pulling of a valve such as valve 12 from the side pocket, the spring 45 in some cases may be relied upon to hold the pivot arm 22 in its kickover position but if a large force is necessary to unseat the valve, as would often be the case, especially where the seals on the valve fit very tightly in the side pocket, the tool carrier 22 may tend to swing about its pivot 46 in a clockwise direction as seen in FIG. 3 and apply its force in non-parallel relation to the side pocket bore. In such cases, it is desirable to provide means for releasably latching the pivot arm in its kickover or non-aligned position shown in FIGS. 2, 3, and 4. This will assure that longitudinal forces applied to the gas lift valve 12 during its installation in or its removal from the side pocket 11 will be applied along the longitudinal axis of the side pocket. The direction of these forces is obviously parallel to the longitudinal axes of the kickover tool and the tubing but offset therefrom.

Since such latching means is to be desired, the pivot arm 22 is provided with a lateral bore 22*f* for receiving a suitable latch pin and the pivot housing is provided with a lateral aperture 28*b* for receiving a portion of such latch pin when the pivot arm is moved to its kickover or non-aligned position to lock the pivot arm in its kickover position. Such latch means will be described later. Except in cases where the valve 12 greatly resists being removed from the side pocket, however, the spring 45 will maintain the pivot arm 22 in its kickover position shown in FIG. 2 and will apply a force to the valve 12 in an axial direction relative to the side pocket 11 and parallel to the longitudinal axes of the kickover tool and the tubing to withdraw the valve from the side pocket.

Suitable cooperating shoulders on the pivot arm 22 and the running tool 47 maintain the valve 12 in longitudinal alignment with the kickover tool during running of the kickover tool into the well and maintain it against swinging back toward the guide 29 while the valve is being inserted into the side pocket. As shown in FIG. 5B, the shoulder 22*d* on the pivot arm cooperates with shoulder 47*a* on the running tool to hold the running tool in the position shown in FIG. 5B. When the pivot arm 22 is pivoted to the kickover position shown in FIG. 2, the running tool 47 pivots about pivot pin 48 until its edge or shoulder 47*b* engages shoulder 22*e* on the pivot arm 22. In this position, the valve 12 is in longitudinal axial alignment with the side pocket and laterally spaced away from the guide 29 and parallel thereto as shown in FIG. 2. The valve 12 will be thus held in axial alignment with the side pocket bore 11*a* as it is moved thereinto even if the side pocket mandrel is disposed horizontally with the side pocket up.

Thus, if the mandrel is inclined as is the case in a deviated well, the valve 12 being run will be held laterally outwardly in longitudinal alignment with the bore of the side pocket even if the pocket is above the kickover tool. This is true although the well bore is deviated so much as to be horizontal and the mandrel is disposed therein with the pocket side upward. Should the mandrel be disposed with the pocket side downward, the valve 12 can swing out into engagement with the wall of the mandrel. There is no force applied against the wall of the mandrel, however, other than a portion of the weight of the valve 12 and this will not be sufficient to cause damage to the valve 12 or to the mandrel. In fact, such engagement should not damage or disturb anti-corrosion coatings which may be present within the mandrel. Thus, no matter what the degree of deviation of the well, the valve 12 is held in a position to be inserted straight into the pocket 11 without being forced outwardly against the wall of the mandrel above the side pocket which could result in damage to the inner walls of the side pocket, the coating in the mandrel, or to the device being landed.

The pulling tool 52 of FIG. 11 has its upper end formed exactly like the upper end of the running tool 47 so that either of them is attachable to the pivot arm 22. When the pulling tool 52 is substituted in the place of running tool 47 for pulling of the valve 12, the shoulder 52*a* thereof similarly engages shoulder 22*e* of the pivot arm to hold the pulling tool 52 in parallelism with the direction of pull on the kickover tool, and this relationship will be maintained up to the strength of the spring 45 or to the strength of this spring plus the strength of any shear pins used to latch the pivot arm in its offset or kicked over position.

During running of the kickover tool, the locking device indicated generally at 49 is releasably secured to the running tool 47 by the shear pins 51 and has the valve 12 threadedly attached to its lower end.

When the kickover tool is used to retrieve a valve from a side pocket, the pulling tool indicated generally at 52 in FIG. 11 is substituted for the running tool 47 by removing the pin 48, exchanging the running tool for the pulling tool and reinstalling the pin 48.

The operation of the kickover tool is controlled by the operator sleeve. The operator sleeve is slidably disposed about the upper housing member 24*a* and carries a plurality of lugs 21 in suitable windows 53*a* formed in the wall of the sleeve. The lugs 21 are radially movable between expanded and retracted positions as the sleeve is moved on the housing between four distinct positions. Position 1 is as shown in FIG. 5A. Position 2 is as shown in FIGS. 8 and 9. Position 3 is as shown in FIG. 10. Position 4 is not shown but is that position in which the operator sleeve 53 moves upwardly, as viewed in FIG. 5A, relative to the housing until the lugs 21 can retract into the recess 54 formed in the exterior surface of the upper housing member 24*a*. Thus, in positions 1 and 2 the lugs 21 are held in expanded position and in positions 3 and 4 the lugs 21 are permitted to retract freely when they engage a shoulder in the well such as the locating shoulder 14.

FIG. 5A shows the relationship of the operator sleeve 53 and upper housing member while the kickover tool is being run into the well and the lugs 21 are not in engagement with a shoulder. This is sleeve position 1. When the lugs 21 engage a shoulder such as the locator shoulder 14, the kickover tool moves downwardly relative to the operator sleeve 53. This places the sleeve in position 4 wherein the lugs 21 readily retract into the external annular recess 54 of the upper housing member 24*a* and permits the kickover tool to bypass such shoulder within the tubing. As soon as the kickover tool passes such shoulder, the operator sleeve 53 is returned to position 1 shown in FIG. 5A by the compression spring 55 which urges the operator sleeve 53 downwardly until the washer or ring 56 engages the upwardly facing shoulder 57 on the upper housing member 24. Thus, the operator sleeve moves between its first and fourth positions upon encountering obstructions during lowering of the tool in the well tubing to permit the lugs 21 to retract, thus enabling the kickover tool to pass locator shoulders and the like in the well.

During running of the kickover tool, the actuator mandrel assembly 36 is latched in its lower position shown in FIG. 5A, that is, in a position relative to the upper housing member 24*a* wherein the pivot arm 22 extends downwardly in substantially longitudinal alignment with the main housing 24 and guide 29. It is latched in this position by releasable latch means which includes a plurality of locking members such as the ball 58. These balls are disposed in suitable apertures 24*c* formed in the wall of the upper housing member 24*a* and are confined in their inner position shown by the confining bore 53*b* of the operator sleeve 53. Being thus confined, the balls protrude into the bore 24*b* of the upper housing member and engage or interfere with the upwardly facing shoulder 43*a* provided by the reduced diameter 43*b* on the upper housing member 43 to maintain the actuator mandrel assembly 36 in its lower position shown in FIG. 5A and to thus maintain the pivot arm retracted. It will be noted that the length of the sleeve bore 53*b* is sufficient to permit the operator sleeve to move upwardly to position 4 and the lugs 21 to retract during running of the kickover tool without disturbing the balls 58. Thus, the reciprocating motion of the operator sleeve 53 on the upper housing member between its positions 1 and 4 during running of the kickover tool into the well does not disturb the latch means which retains the actuator mandrel assembly in its lower position and, therefore, maintains the pivot arm 22 in retracted position in longitudinal alignment with the guide 29.

Means are provided for yieldably resisting upward movement of the upper housing member 24*a* relative to the operator sleeve from its position shown in FIG. 5A so that the lugs 21 normally will be supported in expanded position by the land 53*c* on the upper housing member 24*a*. This yieldable means may be provided in any desired manner which will prevent the operator sleeve 53 from moving below its first position on the housing as shown in FIG. 5A during running of the tool into the well. In the form of the tool illustrated, a compression spring 62 disposed between the shear sub 26 and guide sleeve 63 holds the operator sleeve in the desired position. The guide sleeve 63 has an internal upwardly facing shoulder 63*a* which cooperates with a downwardly facing shoulder 53*d* in the operator sleeve 53. The co-action of these two pairs of shoulders limits the upward travel of the operator sleeve 53 under the influence of spring 62 while permitting the spring 62 to yield and permit the operator sleeve 53 to be arrested in its upward movement while the remainder of the kickover tool continues upwardly to the position shown in FIG. 8. In FIG. 8, the operator sleeve is shown in its second position.

The pivot arm 22 is unlatched for swinging to extended position by upward movement of the kickover tool. After the kickover tool has been run into the well to a point just beyond the selected one of a plurality of identical side pocket mandrels 10 a sufficient distance to place the lugs 21 beyond the locator shoulder 14 of such selected side pocket mandrel and the orienting key 17 beyond the orienting shoe 15, the kickover tool is moved in the opposite direction until the lugs 21 engage the locator shoulder 14. At this time, upward movement of the operator sleeve 53 is arrested by the locator shoulder 14 while the upper housing member 24*a* continues to move upwardly until it reaches the position shown in FIGS. 8 and 9. In this second position of the operator sleeve relative to the housing, the lugs 21 are still held in expanded position by the land 61 as is clearly seen in the drawing. However, the internal recess 65 in the operator sleeve 53 is now opposite the latch balls 58 and the balls are free to be cammed outwardly thereinto by upwardly facing shoulder 43*a* to a position wherein they no longer interfere with the upwardly facing shoulder 43*a*.

Thus, the latch means is released and the actuator mandrel assembly 36 is freed to move upwardly to the position shown in FIG. 9 under the influence of the compression spring 45. When the latch means is released, the upward movement of the actuator assembly swings or pivots the pivot arm 22 about its pivot pin 46 to a position in which the arm extends laterally outwardly of the housing. In the kickover tool illustrated, the pivot arm when in the extended or kicked over position forms an angle of about 90 degrees with the housing, but this is a matter of design since this angle could be somewhat smaller if desired. This kickover tool is now lowered and the valve 12 carried thereby is inserted straight into the pocket 11, or alternatively a valve 12 already in the side pocket is engaged by the pulling tool 52 of FIG. 11 for removal therefrom.

If a valve is being installed, a positive pressure may be exerted by the pump down tool train, or if a wireline is being used, the kickover tool may be jarred downwardly in the conventional manner to fully seat and lock the valve 12 in the pocket 11. Jars may also be utilized with the pump down equipment, if desired, although they are not generally required for running and pulling gas lift valve with kickover tools.

When a valve is being pulled from the side pocket, a constant force may be applied to the kickover tool to withdraw the valve from the side pocket, but jars may be used, if necessary. If wireline tools are used, extraction of the valve will require jarring impacts in virtually every case.

After landing or retrieving a valve, the kickover tool is lifted to a position in which the expanded lugs 21 again engage the locator shoulder 14. The upward movement of the kickover tool is momentarily arrested by the locator shoulder 14 until the operator sleeve moves from its second position on the housing as shown in FIG. 9 to its third position as shown in FIG. 10.

Yieldable means are provided for resisting movement of the operator sleeve from its second to its third position to prevent the operator sleeve from bypassing the second position and moving to the third position before it is desired to remove the kickover tool from the well.

It is sometimes difficult to determine whether or not the kickover tools has been moved upwardly into engagement with the locator shoulder 14 with sufficient force to operate or to activate the kickover tool to kickover position. By providing a yieldable means which holds the operator sleeve in its second position with the lugs expanded, the kickover tool may be moved up and down in the well tubing until it has been ascertained with reasonable satisfaction that the kickover tool has engaged the locator shoulder 14 with sufficient upward force to release the latch means and permit the pivot arm to move into kickover position. In the absence of such yieldable means, the kickover tool could, due to tension in a wireline or due to sudden release of resistance under pump pressure, possibly be moved past the shoulder 14 and out of the side pocket mandrel or junp to a position in which the kickover tool may become disoriented because of its orienting key being in a position above the orienting shoe. In such event, lowering of the kickover tool might be disastrous since the tool, with its pivot arm in its kicked over condition and possibly disoriented position, will almost assuredly become lodged in the side pocket mandrel should the valve 12 miss the pocket 11. This may cause severe damage both to the kickover tool and the valve and the side pocket mandrel. Thus, it is desirable to provide means which prevents movement of the operator sleeve from its second to its third position until after the valve has been installed in the side pocket mandrel and the kickover tool is ready to be withdrawn from the well.

In the illustrated form, such yieldable means is provided by a collar 66 which is releasably slidably secured to the exterior of the shear sub 26 by shear pins 67 in a position to be engaged by the lower end of the operator sleeve 53 when the operator sleeve is in its second position. Since further downward movement of the sleeve on the housing will cause shearing of the pins 67, a greater downward force is required to move the operator sleeve from its second to its third position than is required to move the sleeve from its first to its second positions. In the illustrated embodiment, this downward force required to move the sleeve from its second to its third position is the sum of the force required to collapse the spring 45 and the force necessary to shear the pins 67. Upon the application of such a combined force, the pins 67 shear and the collar 66 and operator sleeve slide downwardly on the upper housing member to the position shown in FIG. 10 wherein the operator sleeve is in its third position and the dogs are free to retract into an external annular recess 68 formed on the upper housing member 24*a* below the land 53*c*. This permits the kickover tool to move upwardly past the locator shoulder 14 as shown in FIG. 10.

Immediately after the lugs pass the shoulder 14, the spring 62 will return the operator sleeve 53 to the position shown in FIG. 9, in which position the latch balls 58 will engage the lower end of internal recess 65 in the operator sleeve and will prevent further upward movement of the operator sleeve relative to the upper housing member.

As the kickover tool is withdrawn from the enlarged bore of the side pocket mandrel into the tubing thereabove, the pivot arm 22 will engage the side wall of the abruptly tapered bore of the side pocket mandrel and will be forced to swing downwardly almost to its retracted position shown in FIG. 1. The pivot arm is not normally swung downwardly at such time sufficiently far against the force of spring 45 to permit the balls 58 to retract and permit the operator sleeve 53 to return to its first position shown in FIG. 5A, although it could possibly do so. If the operator sleeve should be returned to its first position to retain the actuator mandrel assembly in its lower or pivot arm retracting position, it would be released again upon encountering the next obstruction in the tubing such as another shoulder 14. At such time the operator sleeve would move down to its second position on the housing releasing the actuator mandrel assembly to permit the pivot arm to swing outwardly. The operator sleeve would continue its downward movement on the housing until reaching its third position wherein the lugs would retract into the recess 68 as shown in FIG. 10 and permit the kickover tool to continue upwardly in the well tubing as before.

Alternatively, if the pivot arm is not swung inwardly sufficiently far to cause resetting of the actuator mandrel assembly by engagement of the balls therewith, the pivot arm merely rides against the side wall of the tubing as the kickover tool is withdrawn from the well.

Since it is not usually determinable beforehand just how much force will be required to extract a valve from a side pocket because such force required is dependent upon several variables such as the interference between the valve packing and the seal bore of the pocket, the lubricity of the well fluids in the side pocket, the well temperature at the valve, the presence and location of any solid particles or detritus such as sand, and possibly other factors. It is, therefore, preferable when retrieving valves to provide means for latching the pivot arm 22 in its kicked over or non-aligned position so that greater upward forces, even jarring impacts, can be applied in extracting the valve from the pocket. Otherwise, the pivot arm may be caused to swing from its fully extended position and permit such force to be applied to the valve at some angle displaced from its longitudinal axis. Such latching means are illustrated in FIG. 12 through 17 and will now be described.

FIG. 12 is a view similar to FIG. 5B but shows a kickover tool having a shear pin 81 disposed in the blind hole 22*f* formed in the pivot arm 22. The shear pin 81 is biased outwardly at all times by a spring 82 disposed between the shear pin and the bottom of the hole 22*f* as is clearly seen in FIG. 13. When the pivot arm 22 is in its retracted position, as is shown in FIGS. 12 and 13, the shear pin 81 is confined within the pivot arm and has its outer end engaged with the inner wall of the slot 28*p* in which the pivot arm is disposed. When the kickover tool is actuated and the pivot arm 22 is pivoted to its kicked over or non-aligned position, as is shown in FIG. 15, the shear pin hole 22*f* of the pivot arm becomes aligned with the shear pin hole 28*b* formed in the pivot housing 28, and the spring 82 forces the shear pin 81 outwardly into engagement in the shear pin hole 28*f*. An inwardly facing shoulder is provided by the restricted portion 28*d* of shear pin hole 28*c* to limit the outward travel of the shear pin. In this position, the shear pin 81 positively locks the pivot arm in its extended or kickover position against movement back towards its retracted or aligned position. As before explained, when the pivot arm 22 is in its kicked over or non-aligned position, the running tool 47 will be in its laterally offset position as shown in FIGS. 2 through 4 and will be aimed directly axially into the side pocket 11. When the kickover tool is in this condition, any upward force applied therethrough to a valve which is already disposed in the side pocket 11 will be applied longitudinally axially relative to the side pocket and valve and parallel to the axes of the kickover tool and well tubing so that any binding between the valve and the side pocket will be minimized.

After a valve 12 has been installed in or withdrawn from the side pocket 11, continued upward movement of the kickover tool relative to the side pocket mandrel will cause the extended or kicked over pivot arm 12 to engage the upper end of the enlarged portion of the side pocket mandrel as before explained, and continued upward movement of the kickover tool will cause the shear pin 81 to become sheared thus permitting the pivot arm to pivot downwardly relative to the housing towards its initial position of alignment therewith. The kickover tool then may be readily withdrawn from the side pocket mandrel through the bore of the well tubing thereabove although the spring biased pivot arm will drag against the tubing wall during such withdrawal of the kickover tool.

It is readily seen that the downward force on the pivot arm 22 required to swing it away from its extended position in which it is locked is much greater when a shear pin 81 is present in the device, as shown in FIGS. 12 through 15, than when no shear pin is present. Thus, the kickover tool, when equipped with a shear pin 81, is better adpated to extracting devices from side pocket mandrels. The shear pin will positively lock the pivot arm 22 in its extended or kicked over position so that upward forces may be more efficiently applied to extract a valve from the side pocket 11 because such force is applied longitudinally axially relative thereto and to the side pocket.

It is understood that shear pins 81 of desired shear strength may be provided by forming the same of a selected material, such as steel, brass, or the like, having a suitable shear valve and cross section.

If desired, the shear pin hole 28*d* may be eliminated by running the shear pin hole 28*c* completely through the pivot housing 28. In such case, the end of the shear pin hole may be tapped and a suitable screw installed therein to limit outward movement of the shear pin in exactly the same manner that the shoulder provided by restricted bore 28*d* limited the travel of the shear pin as before explained. The screw is then removable to provide easy access for changing the shear pin without disassembling the kickover tool.

It is readily understood that force required to extract a valve from a receptacle is at a minimum when the force is applied axially, that is, along the longitudinal axis of the receptacle.

In FIG. 17 is illustrated a modified form 20*a* of kickover tool which is adapted to applying even greater upward forces to valves for extracting them from side pockets. In this device, the modified pivot housing 28*n* has a transverse shear pin aperture which passes completely through the pivot body as is shown and, because this aperture runs across or through the slot 28*p* in which the pivot arm 22 is disposed, two shear pin holes 28*f* and 28*g* are provided. These two shear pin holes are counterbored or enlarged at their inner ends, as at 28*h* and 28*i*, to receive the outer ends of shear pins 86 and 87, respectively, which are disposed in the shear pin aperture 22*i* of the modified pivot arm with a spring such as the coil spring 82 compressed therebetween to bias them outwardly. When the kickover tool is activated and the pivot arm 22 has pivoted to its extended position, the shear pins 86 and 87 come into alignment with the shear pin holes 28*h* and 28*i*, respectively, and engage therein, their outward movement being limited by the reduced diameter bores 28*f* and 28*g*, respectively. The shear pins 86 and 87 thus lock the pivot arm in its extended position. The two shear pins double the shear strength of the latch means. Thus, the added shear strength enables the kickover tool to extract valves from side pockets even when such valves become stuck or are otherwise difficult to extract.

When the valve has been withdrawn from the side pocket and the kickover tool is lifted, the extended pivot arm 22 engages the tapered portion of the enlarged bore of the side pocket mandrel. Further upward movement of the kickover tool then causes the pivot arm 22 to be swung downwardly towards retracted position, thus shearing both of the shear pins 86 and 87 permitting the kickover tool to be withdrawn from the side pocket mandrel through the well tubing thereabove.

When the shearing surfaces at the inner ends of the shear pin holes 28*h* and 28*i* become dull and/or the shearing surfaces of the outer ends of the shear pin hole 22*i* of the pivot arm become dull or damaged, the shear pin holes may be required by boring them out and installing hardened bushings therein to provide new and more durable shear surfaces. Such bushings are shown installed in FIG. 16. Shear pin hole 28*d* has been enlarged as at 28*k* completely through the pivot housing 28*n* and a pair of hardened bushings 28*m* and 28*s* are disposed therein providing new shear pin holes 28*h* and 28*i*. The bushings may be secured in place by any suitable means such as by silver soldering, or the like. Also, the shear pin hole 22*i* through the pivot arm 22 has been enlarged as at 22*g* and a hardened bushing 22*h* is disposed therein in like manner to provide a new shear pin hole 22*i*. In making such repairs using bushings, it may be desirable to place the pivot arm in its kicked over or fully extended position with its surface 22*c* in engagement with shoulder 28*a* of the pivot housing 28, and holding it firmly in this position, drill and ream both the hole 28*h* through the pivot housing and the hole 22*g* through the pivot arm. This procedure will assure proper alignment of the new shear pin holes. The use of these bushings may also be desired should it be found difficult to counterbore the shear pin hole 28*d* to provide the enlarged counterbores 28*h* and 28*i* in the pivot housing 28*c*.

While the means disclosed herein for latching the pivot arm in extended position include one or more shear pins, it should be understood that other means such as a mechanical detent could be used if desired.

Thus, the kickover tool described hereinabove is versatile inasmuch as it can be used with one or two shear pins or even without one, if desired, and should the shear pin holes become damaged so that the shearing surfaces provided thereby are no longer in condition to perform satisfactorily, they may be bored out and hardened bushings installed therein to restore the shearing efficiency and provide shearing surfaces which are even more durable than were the original ones.

It may be desirable when changing valves in side pocket mandrels to have the side pocket 11 empty for a minimum of time. In such case, two kickover tools 20 or 20*a* may be connected together and run in tandem. It will be noticed that the end of the orienting housing 18 is reduced in diameter and is externally threaded as at 18*a* to accept the upper internally threaded end of the coupling 16 of a second kickover tool. Preferably, the upper of the two kickover tools has a pulling tool 52 (FIG. 11) carried by its pivot arm and the lower kickover tool is provided as shown in FIG. 5A, 5B and 5C with a running tool 47 and a replacement valve such as the gas lift valve 12.

The tandem kickover tools are lowered into the well to a location just below the side pocket mandrel containing the valve to be replaced. The kickover tools are then lifted to engage the shoulder 14 and orienting shoe 15 to orient and activate the upper kickover tool, lowered to engage the pulling tool with the valve in the side pocket, and lifted again to withdraw the valve from the side pocket and to withdraw the upper kickover tool from the side pocket mandrel. The kickover tools are lifted further to engage the shoulder 14 and orienting shoe 15 to orient and activate the lower kickover tool, lowered to install the replacement valve in the side pocket, and lifted again to withdraw the lower kickover tool from the side pocket mandrel. Thus, a valve in a side pocket mandrel can be replaced by another using two kickover tools 20 in tandem and the side pocket need be bared for only a very short period of time, thus minimizing the amount of flow which can take place through the empty side pocket. If such operation is performed with pump down equipment, pistons located in the tool train above and below the tandem kickover tools will isolate the side pocket mandrel during the changing of the valve and will hold transfer of fluids through the side pocket to a bare minimum.

The use of tandem kickover tools is more fully explained in U.S. Pat. No. 3,732,928 mentioned above.

While the kickover tools 20 and 20*a* have been described in connection with running and pulling gas lift valves in side pocket mandrels, it is obvious that other devices can be installed and removed through their use. For instance, check valves, plugs or dummy gas lift valves or the like can be attached to the lower end of the locking device 49 and be run and pulled in exactly the same manner as was the gas lift valve 12.

From the foregoing, it is believed that the operation of the tool is clear. When it is desired to run a device such as the gas lift valve 12 into a well and install it in a side pocket mandrel such as the side pocket mandrel 10, a kickover tool such as that shown in FIG. 5 may be used. Such tool utilizes a running tool 47 to carry the device until it is installed in the side pocket. When it is desired to retrieve such a device from the well, the pulling tool 52 shown in FIG. 11 is substituted for the running tool 47. In either case, after the kickover tool has been lowered past the desired locator shouler 14, the tool is raised and orienting key 17 cooperates with the orienting shoe 15 to orient the tool as shown in FIG. 1. The kickover tool is then moved upwardly until the lugs 21 engage the locator shoulder 14 and release the latch means as shown in FIG. 8 and cause the pivot arm 22 to kickover to extended position as shown in FIG. 2 under the bias of spring 45. The kickover tool is then lowered as shown in FIG. 3. In the event a device is being run, the locking device 49 will be released from the kickover tool by shearing of the pins 51. After the pins shear, further downward movement of the kickover tool moves the expander 69 downwardly to expand the locking lugs 71 into engagement in a recess formed in the side pocket 11 near its upper end and latch the tool in place in the well.

In the event a retrieving tool 52 of FIG. 11 is being utilized, it telescopes over the upper end of the expander 69 and the collet fingers 72 engage about the enlarged head formed thereon, after which lifting of the kickover tool lifts the expander to the position shown in FIG. 5B, permitting the lugs 71 to retract, thus permitting the device to be extracted from the side pocket by lifting the kickover tool.

After a device has been installed in or removed from the side pocket, the kickover tool is then moved upwardly until the lugs 21 again engage the locator shoulder 14, at which time further upward movement of the kickover tool causes the yieldable means provided by the collar 66 and shear pins 67 to fail, as before explained, permitting relative movement of the control sleeve 53 on the upper housing member **24*a* as shown in FIG. 10, thus permitting the lugs 21 to retract and pass the locator shoulder 14. Further upward movement of the kickover tool will at this time cause the pivot arm 22 to be pivoted towards its FIG. 5B** position as it is withdrawn from the enlarged bore of the side pocket mandrel into the tubing thereabove, permitting the kickover tool to be lifted to the surface.

Thus, it has been shown that a new and improved kickover tool has been provided which is adapted to install a device such as a gas lift valve in and remove such device from the side pocket receptacle of a side pocket mandrel. It has also been shown that such kickover tool includes a pivotable pivot arm which is actuable from a position wherein it is in substantial alignment with the kickover tool to a position in which it extends outwardly thereof at approximately 90 degrees thereto; that the kickover tool with its pivot arm held in the thus kicked over position is adapted to apply a longitudinal axial force to a device such as a gas lift valve to force such device straight into or out of a side pocket receptacle without binding and therefore decreasing the efficiency of the work forces involved; and that the tool carrier of such kickover tool is held in its kicked over position by a substantial spring force which may, if desired, be supplemented by latching means which may include one or more shear pins which, when the tool carrier is pivoted to and reaches its extended or kicked over position, are biased into latching position to lock the tool carrier in such extended position. It has been further shown that the means for latching the pivot arm of the kickover tool in its kicked over or extended position are readily releasable and are automatically released as the kickover tool is withdrawn from the side pocket mandrel, permitting the tool carrier to yeildingly swing back towards its initial position of longitudinal alignment with the housing so that the kickover tool may be easily withdrawn from the well; that such shear pins may be selected for size and materials to provide the shear strength desired; and that when the shear pin holes become damaged they can be bored out and hardened bushings installed therein to restore their shearing surfaces to that they are more durable than before. It has also been shown that such kickover tool is provided with orienting means for assuring that the pivot arm will be oriented with respect to a side pocket in a tubing string; and that such kickover tool is provided with means for orienting it and activating it to kicked over position in any selected one of a plurality of identical side pocket mandrels made up in a well tubing string at longitudinally spaced locations therein. In addition, it has been shown that such kickover tools may be used in tandem, that is, two kickover tools may be attached to one another, the upper kickover tool being equipped with a retrieving tool and the lower kickover tool being equipped with a replacement device, thus, making it expedient to extract an existing device from a side pocket with the upper kickover tool and then install the replacement device in its place with the lower kickover tool without permitting any significant quantity of fluids to flow through the side pocket during the short time that such device is absent from the side pocket bore; and that the design of the kickover tool with its pivot arm movable to a 90 degree kickover position and with the orienting key means provided at its lower end makes for a shorter kickover tool which is better adapted to negotiating short radius turns in the well flow conductor when the tool is operated by pump down techiques.

The foregoing disclosure and description of the invention are illustrative and explanatory only and various changes in the size, shape and materials, as well as in the details of the illustrated construction, may be made within the scope of the appended claims without departing from the true spirit of the invention.

What is claimed and desired to be secured by Letters Patent is:

1. A kickover tool for installing a device in the side pocket of a side pocket mandrel in a well tubing having a shoulder therein, comprising:

an elongated body;

actuator means arranged in telescopic relationship with said body and movable longitudinally relative thereto;

pivot arm means carried by one and positively connected to the other of said body and said actuator means and movable from a retracted position of longitudinal alignment with said body to an extended position laterally outwardly of said body upon relative longitudinal movement between said body and said actuator means;

releasable latching means initially engageable with said actuator means and said body means for preventing relative longitudinal movement between said body and said actuator means; and means on said body operatively associated with said releasable latching means and engageable with a shoulder in said tubing for moving said releasable latching means to a position permitting longitudinal movement of said actuator means relative to said body upon relative upward movement of said kickover tool in said tubing.

2. The kickover tool of claim 1 including means urging said actuator means in a direction to pivot said pivot arm means from retracted towards extended position.

3. The kickover tool of claim 1 including guide means extending downwardly from one of said body and said actuator means on which said pivot arm means is carried;

device attachment means pivotally attached to said pivot arm means, and shoulder means on said pivot arm means and said device attachment means coengageable to maintain said device attachment means offset from said guide means after said releasable latching means is released.

4. The kickover tool of claim 3 including means for rendering the means for engaging a shoulder in the tubing ineffective upon the application of a predetermined upward force against said shoulder by said kickover tool.

5. The kickover tool of claim 4 including means connected to said body for orienting the kickover tool with respect to the side pocket in the tubing.

6. The kickover tool of claim 5 in combination with a side pocket mandrel for use in a well tubing comprising: a mandrel body having connecting means at each end for connection in a well tubing and having an open bore therethrough disposed for alignment with the well tubing; a side pocket positioned in the body offset laterally from the open bore; an orienting sleeve positioned in the open bore adjacent the side pocket, said sleeve including a longitudinally directed orienting slot; a guide surface positioned below said slot and directed upwardly from the lower end of the sleeve toward the bottom of the slot for orienting said kickover tool relative to the side pocket; and a downwardly directed actuating shoulder in the body above the pocket for actuating said kickover tool.

7. A kickover tool comprising an elongate tubular body having an opening in the side thereof and adapted to be run in a well tubing;

actuator means slidably mounted in the bore of said body;

pivot arm means pivotally mounted on said body at said side opening and connected to said actuator means, said pivot arm means being swingable through said opening in said body from a position longitudinally aligned with said body to an extended position laterally outwardly thereof upon relative longitudinal movement between said body and said actuator means;

means urging said actuator means in a direction to move said pivot arm means to said extended position;

operator sleeve means slidably mounted on said body and having lug means thereon, said operator sleeve means being movable between first, second, and third positions;

means on said body holding said lug means expanded when said operator sleeve means is in said first and second positions and permitting said lug means to retract when said operator sleeve means is in said third position:

releasable means carried by said body and releasably engageable with said actuator mean for holding said actuator means against the force of said urging means; and means on said operator sleeve means holding said releasable means in latched position when said operator sleeve means is in said first position and for releasing said releasable means when the operator sleeve means is in said second position.

8. The kickover tool of claim 7 including first means yieldably resisting movement of said operator sleeve means from said first to said second position; and second means yieldably resisting movement of said operator sleeve means from said second to said third position.

9. The kickover tool of claim 6 including resilient means for urging said opeator sleeve means toward said first position; and means on said body for permitting said lug means to retract upon longitudinal movement of said operator sleeve to a fourth position.

10. The kickover tool of claim 9 including guide means extending downwardly from said body for guiding the kickover tool past side pockets in the tubing;

device attachment means pivotally attached to said pivot arms means; and coengageable shoulders on said pivot arm means and said device attachment means coengageable for holding said device attachment means offset from and substantially parallel to said body.

11. The kickover tool of claim 10 including means connected with the body for orienting the kickover tool with respect to the side pocket in the tubing.

12. The kickover tool of claim 9 in combination with a side pocket mandrel for use in a well tubing comprising: a mandrel body having connecting means at each end for connection in a well tubing and having an open bore for alignment with the well tubing; a side pocket positioned in the body offset from the open bore; an orienting sleeve positioned in the open bore adjacent the side pocket and positioned below the pocket, said sleeve including a longitudinally directed orienting slot; a guide surface positioned below such slot and directed upwardly toward the bottom of the slot for orienting said kickover tool relative to the side pocket; and a downwardly directed actuating shoulder in the body above the pocket for actuating said kickover tool.

13. A kickover tool comprising:

an elongate body adapted to be run in a well tubing;

actuator means longitudinally disposed in a first telescopic relationship within said body;

pivot arm means pivotally mounted on one and connected to the other of said body and actuator means for movement from a first retracted position of longitudinal alignment within said body to a second offset position of non-alignment with said body upon relative longitudinal movement between said body and said actuator means;

releasable means holding said body and said actuator means in said first telescopic relationship for maintaining said pivot arm means in said first retracted position;

means for moving said body and said actuator means from said first telescopic relationship to said second telescopic relationship upon release of said releasable means to pivot said pivot means from said first retracted position to said second non-aligned position;

operator sleeve means slidably mounted on said body and movable longitudinally relative thereto between first, second and third positions;

lug means on said operator sleeve means movable laterally between expanded and retracted positions;

means for holding said lug means expanded when said operator means is in said first and second positions; and means for releasing said releasable means when said operator sleeve is moved from said second position to said third position to permit said lug means to retract.

14. The kickover tool of claim 13 including means for yieldably resisting movement of said operator sleeve means from said first position to said second and third positions.

15. The kickover tool of claim 13 including resilient means for urging said operator sleeve means toward said first position; means for permitting said lug means to retract upon movement of said operator sleeve means to said fourth position; and means connected to said body for orienting said kickover tool in the tubing.

16. A kickover tool comprising:

an elongate body adapted to be run in a well tubing;

pivot arm means pivotally mounted on said body and releasably held in a first position for running and pivotable to a second position for setting or pulling of a device;

operator sleeve means slidably mounted on the body for movement between first, second, third, and fourth positions for controlling operation of the kickover tool;

lug means on said operator sleeve means movable laterally between expanded and retraced positions;

means maintaining said lug means expanded when said operator sleeve means is in said first and second positions on said body and permitting said lug means to retract when said operator sleeve means is in said third position;

means on said body associated with said operator sleeve means for releasing said pivot arm means for movement from said first to said second position upon movement of said operator sleeve means from said first to said second position on said body; and means yieldably resisting movement of said operator sleeve means from said first to said second position and from said second to said third position on said body.

17. The kickover tool of claim 16 ncluding additional means for yieldably resisting movement of said operator sleeve means from said second to said third position on said body, whereby a greater force is required to move the operator sleeve means from said second to said third position on the body than is required to move said operator sleeve means from said first position to said second position on the body, and orienting means connected to the body for orienting the kickover tool in the tubing.

18. The kickover tool of claim 17 wherein said lug means are adapted to engage a shoulder in the well tubing.

19. The kickover tool of claim 17 in combination with a side pocket mandrel for use in a well tubing comprising: a mandrel body having connecting means at each end for connection in a well tubing and having an open bore for alignment with the well tubing; a side pocket positioned in the body offset from the open bore; an orienting sleeve positioned in the open bore adjacent the side pocket and positioned below the pocket, said sleeve including a longitudinally directed orienting slot; a guide surface positioned below such slot and directed upwardly toward the bottom of the slot for orienting said kickover tool relative to the side pocket; and a downwardly directed actuating shoulder in the body above the pocket for actuating said kickover tool.

20. A kickover tool for running and retrieving well equipment comprising:

an elongate housing;

a pivot arm pivoted to the housing;

means carried by the pivot arm for releasably securing thereto equipment to be run or retrieved;

means in the housing including means for engaging a shoulder in a well for pivoting said pivot arm from a position aligned with the housing to a position of nonalignment with the housing;

latching means for latching said pivot arm in non-aligned position; and means for releasing said latching means in response to upward movement of said tool in a well.

21. The kickover tool of claim 20 wherein said latching means includes: recess means in said pivot arm; shear pin means in said recess of said pivot arm; means in said housing engageable by said shear pin means; and means for biasing said shear pin to a position of engagement with said means in said housing.

22. The kickover tool of claim 20 wherein said latching means comprises shear pin means on said pivot arm and means on said housing engageable by said shear pin means when said pivot arm is in the non-aligned position to positively latch said pivot arm in the non-aligned position, said shear pin being shearable upon movement of said pivot arm from the non-aligned position towards its position of alignment with said housing.

23. The kickover tool of claim 22 wherein said means for engaging a shoulder in a well comprises an operator sleeve slidably mounted on said housing and lugs expansibly and retractably carried by said operator sleeve means and movable into and out of position to engage a shoulder in a well.

24. The kickover tool of claim 23 including means on said housing for holding said lugs in shoulder engaging position when said operator sleeve is in a first position on said housing and permitting said lugs to retract when said operator sleeve is in a second position on said housing; and means for yieldably resisting movement of said operator sleeve means to said second position on said housing.

25. The kickover tool of claim 24 including means for orienting the kickover tool with respect to a side pocket in the well.

26. The kickover tool of claim 25 wherein the means in said housing engageable by said shear pin is a shear pin hole formed in said housing and adapted to receive a portion of said shear pin when said pivot arm is moved to its non-aligned position.

27. A kickover tool for use in installing a device in or removing a device from the side pocket of a side pocket mandrel in a well tubing having a locator shoulder therein, comprising:

an elongate body;

a pivot arm pivotally mounted on said body;

means carried by said pivot arm for releasably securing thereto a device to be installed in or removed from said side pocket;

actuator means carried on said body and movable longitudinally thereof for moving said pivot arm from a retracted position of longitudinal alignment with said housing to an extended position holding the releasable securing means on said pivot arm in longitudinal axial alignment with the side pocket;

releasable means releasably engageable with said actuator means initially holding said actuator means against longitudinal movement relative to said housing; and means carried by said housing engageable with said locator shoulder in said well tubing for releasing said releasable means upon upward movement of the kickover tool in said well tubing to permit said actuator means to move said pivot arm from said aligned to said non-aligned position.

28. The kickover tool of claim 27 wherein said means for engaging a shoulder in a well comprises an operator sleeve slidably mounted on said body and lugs expansibly and retractably carried by said operator sleeve means and movable into and out of position to engage a shoulder in a well.

29. The kickover tool of claim 28 including means on said body for holding said lugs in shoulder engaging position when said operator sleeve is in a first position on said body and permitting said lugs to retract when said operator sleeve is in a second position on said body; and means for yieldably resisting movement of said operator sleeve means to said second position on said body.

30. The kickover tool of claim 29 wherein said latching means comprises shear pin means on said pivot arm and means on said housing coengageable to latch said pivot arm in extended position, said shear pin being shearable upon movement of said pivot arm from its extended position towards its retracted position.

31. The kickover tool of claim 28 including means connected to the body for orienting the kickover tool with respect to the side pocket in the well.

32. The kickover tool of claim 31 in combination with a side pocket mandrel for use in a well tubing comprising: a mandrel body having connecting means at each end for connection in a well tubing and having an open bore for alignment with the well tubing; a side pocket positioned in the body offset from the open bore; an orienting sleeve positioned in the open bore adjacent the side pocket and positioned below the pocket, said sleeve including a longitudinally directed orienting slot; a guide surface positioned below such slot and directed upwardly toward the bottom of the slot for orienting said kickover tool relative to the side pocket; and a downwardly directed actuating shoulder in the body above the pocket for actuating said kickover tool.

33. A kickover tool for installing a device in the offset side pocket of a side pocket mandrel in a well tubing having a shoulder therein, comprising:

an elongate housing;

a pivot arm on said housing pivotable relative thereto from a retracted position to a laterally projecting position;

means carried by said pivot arm for releasably securing thereto said device to be installed in said side pocket;

means in said housing including means for engaging a shoulder in a well for pivoting said pivot arm from said retracted to said laterally projecting position;

latching means positively operatively engageable with said pivot arm for positively latching said pivot arm in said laterally projecting position; and means for releasing said positive latching means in response to upward movement of said kickover tool in said well tubing to free said pivot arm for movement of said pivot arm to retracted position.

34. The kickover tool of claim 33 wherein said means carried by said pivot arm for releasably securing said device thereto is a running tool pivotably connected to the swingable end of said pivot arm, and including:

coengageable means between said housing and said pivot arm and between said pivot arm and said running tool providing a positive drive connection independent of the pivot of said pivot arm and holding said running tool in a position of longitudinal alignment with said side pocket whereby said device is movable by said kickover tool straight into the bore of said offset side pocket.

35. The kickover tool of claim 33 wherein the means carried by said pivot arm is a retrieving tool adapted to engage and remove a device from said offset side pocket.

36. A tubing mandrel for use in a well tubing comprising, a mandrel body having connecting means at each end for connection in a well tubing and having an open longitudinal bore for alignment with the well tubing, a valve pocket positioned in the body offset from the open bore, an orienting sleeve positioned in the open bore laterally adjacent the pocket, said sleeve including a longitudinally directed orienting slot angularly spaced from the axis of the pocket a predetermined amount, a guide surface on the sleeve positioned below such slot and directed upwardly toward the bottom of the slot for orienting a valve handling apparatus relative to the pocket, and a downwardly directed actuating shoulder in the body above the pocket for actuating a valve handling apparatus.

37. The side pocket mandrel of claim 36 wherein the orienting slot is disposed in predetermined relationship with the side pocket relative to the axis of the open bore for orienting a kickover tool with respect to the side pocket.

38. The side pocket mandrel of claim 37 wherein the upper end of the orienting sleeve is disposed between the upper and lower ends of the side pocket.

39. The side pocket mandrel of claim 38 including flow passage means in said orienting sleeve communicating the main bore of the mandrel with the side pocket.

40. A side pocket mandrel for use in a well tubing comprising: a mandrel body having connecting means at each end for connection in a well tubing and having an open bore for alignment with the well tubing; a side pocket positioned in the body offset from the open bore; an orienting sleeve positioned in the open bore and located adjacent the side pocket at a point between the upper end thereof and the lower end of the mandrel; a guide surface on said sleeve directed upwardly toward an opening therein for orienting a kickover tool relative to the side pocket; and a downwardly directed actuating shoulder in the body above the pocket for actuating the kickover tool.

41. A tubing mandrel for use in a well tubing comprising, a mandrel body having connecting means at each end for connection in a well tubing and having an open bore for alignment with the well tubing, a valve pocket positioned in the body offset from the open bore, an orientation sleeve positioned in the open bore adjacent the pocket and positioned below the pocket, said sleeve including a longitudinally directed orientation slot in said sleeve and angularly spaced from the axis of the pocket a predetermined amount, a guide surface positioned below such slot and directed upwardly toward the bottom of the slot for orientating a valve handling apparatus relative to the pocket, and a downwardly directed actuating shoulder in the body above the pocket for actuating a valve handling apparatus.

42. A tubing mandrel for use in a well tubing comprising, a mandrel body having connecting means at each end for connection in a well tubing and having an open bore for alignment with the well tubing, a valve pocket positioned in the body offset from the open bore, an orientation sleeve positioned in the open bore adjacent the pocket, said sleeve including a longitudinally directed orientation slot extending longitudinally of said sleeve and angularly spaced from the axis of the pocket a predetermined amount, a guide surface positioned below such slot and directed upwardly toward the bottom of the slot for orientating a valve handling apparatus relative to the pocket, a downwardly directed actuating shoulder in the body above the pocket for actuating a valve handling apparatus, and a valve handling apparatus comprising, a support body adapted to be moved in the well tubing, actuating key means on said support body having an upwardly directed shoulder for coacting with the actuating shoulder in the mandrel and longitudinally movably carried by the support body adjacent the top of the support body, a shifting tool pivotally supported from the support body for supporting a valve handling support, releasing means between the shifting tool and the actuating key for initially holding the shifting tool aligned in the open bore, shifting means connected to the shifting tool for shifting the shifting tool into position over the pocket when the releasing means is actuated, and an orientating key carried by the support body adjacent the lower end of the support body, said orienting key having an upwardly directed shoulder for coacting with the orientation sleeve for orientating the shifting tool and actuating key relative to the mandrel.

43. A side pocket mandrel for use in a well tubing comprising: a mandrel body having connecting means at each end for connection in a well tubing and having an open bore for alignment with the well tubing; a side pocket positioned in the body offset from the open bore and having its open end facing upwardly; an orienting sleeve positioned in the open bore adjacent the side pocket and having its upper end located between the upper end of the side pocket and the lower end of the mandrel, said sleeve including a longitudinally directed oriented slot; a guide surface on said sleeve positioned below such slot and directed upwardly toward the bottom of the slot for orienting a kickover valve handling apparatus relative to the side pocket, said adjacent positioning of said orienting sleeve and said side pocket providing for short kickover valve handling apparatus; and a downwardly directed actuating shoulder in the body above the pocket for actuating a kickover valve handling apparatus.

44. A kickover tool for running and retrieving well equipment comprising:

an elongate housing;

a pivot arm pivoted to the housing;

means carried by the pivot arm for releasably securing thereto equipment to be run or retrieved;

actuator means in the housing positively engageable with said pivot arm for positively pivoting said pivot arm from a position aligned with the housing to a position of nonalignment with the housing;

latching means on said pivot arm engageable with means on said housing for positively latching said pivot arm in nonaligned position; and means for releasing said latching means from latching engagement with said means on said housing to permit movement of said pivot arm to aligned position with respect to said housing in response to upward movement of said tool in a well.

45. The kickover tool of claim 44 including means for orienting the kickover tool with respect to a side pocket in a well.

46. The kickover tool of claim 44 wherein said latching means comprises shear pin means on said pivot arm and means on said housing engageable by said shear pin means when said pivot arm is in the nonalgined position to positively latch said pivot arm in the nonaligned position, said shear pin being shearable upon movement of said pivot arm from the nonaligned position towards its position of alignment with said housing.

47. The kickover tool of claim 46 wherein said means for engaging a shoulder in a well comprises an operator sleeve slidably mounted on said housing and lugs expansibly and retractably carried by said operator sleeve means and movable into and out of position to engage a shoulder in a well.

48. The kickover tool of claim 47 including means on said housing for holding said lugs in shoulder engaging position when said operator sleeve is in a first position on said housing and permitting said lugs to retract when said operator sleeve is in a second position on said housing; and means for yieldably resisting movement of said operator sleeve means to said second position on said housing.

49. The kickover tool of claim 48 wherein said latching means includes: recess means in said pivot arm; shear pin means in said recess of said pivot arm; means in said housing engageable by said shear pin means; and means for biasing said shear pin to a position of engagement with said means in said housing.

50. The kickover tool of claim 49 wherein the means in said housing engageable by said shear pin is a shear pin hold formed in said housing and adapted to receive a portion of said shear pin when said pivot arm is moved to its nonaligned position.

51. A side pocket mandrel for use in a well tubing comprising: a mandrel body having connecting means at each end for connection in a well tubing and having an open bore for alignment with the well tubing; a side pocket positioned in the body offset from the open bore and having its open end facing upwardly; an orienting sleeve positioned in the open bore laterally adjacent the side pocket and having its upper end located between the upper end of the side pocket and the lower end thereof, said sleeve having a longitudinally directed orienting slot; a guide surface on said sleeve positioned below such slot and directed upwardly toward the bottom of the slot for orienting a kickover valve handling apparatus relative to the side pocket; and a downwardly directed actuating shoulder in the body above the pocket for actuating a kickover valve handling apparatus.

52. A flow control device handling apparatus adapted for use in placing a flow control device in a selected offset pocket in a mandrel having an orientating sleeve in a well tubing and for removing said device therefrom comprising, a body adapted to be moved through the well tubing, a flow control device handling arm supported from the body, means for laterally shifting said handling arm into position over a selected pocket when the body is oriented, orientating means connected to the body for coacting with the orientating sleeve for orientating the handling arm relative to the pocket, and universal joint means in the body between the orientating means and the handling arm for allowing the body to pivot about the universal joint for allowing movement of the body through curved well tubing, but maintaining the orientating means and the handling arm in a predetermined rotational alignment for providing orientation of the handling arm.

53. The apparatus of claim 52 wherein the universal joint is a ball joint having first and second members, one of the members including a slot parallel to the longitudinal axis of the body, and the second member includes a pin positioned in the slot and axially aligned with the center of the joint.

54. A flow control device handling apparatus adapted for use in placing a flow control device in a selected offset pocket in a well tubing and for removing said device therefrom comprising, a body adapted to be moved through the well tubing, a flow control device handling arm pivotally connected to the body, shifting means for pivoting the handling arm relative to the body, releasable engaging means coacting between the body and the handling arm initially preventing the handling arm from being shifted until the engaging means is released, locating means carried by the body for releasing the engaging means including a locator shoulder protruding upwardly and adapted to contract a shoulder in the tubing for actuating the releasing engaging means, a universal joint means intermediate the ends of the body for allowing the ends of the body to pivot relative to each other to be moved through curved tubing, said universal joint means is positioned between the locator shoulder and the handling arm, and said locating means includes an actuator movable through the joint for releasing the engaging means.

55. A flow control device handling apparatus for use in placing a flow control device in a selected offset pocket in a mandrel having an orientating sleeve in a well tubing and for removing said device therefrom comprising, a body adapted to be moved through the well tubing, said body including an elongated guide means adapted to be lowered through the well tubing and bypass said seat, a flow control device handling arm pivotally connected to the guide means, shifting means for pivoting the handling arm relative to the guide means, releasable engaging means coacting between the guide means and the handling arm initially preventing the handling arm from being shifted until the engaging means is released, orientating means carried by the body for releasing the engaging means including a locator key adapted to coact with an orientating sleeve for orientating the body relative to the pocket, and a universal joint means in the body positioned between the locating means and the handling arm for allowing the ends of the body to pivot relative to each other for allowing movement of the body through curved well tubing, but maintaining the ends of the body in rotational alignment for providing orientation of the handling arm.

56. The apparatus of claim 55 wherein the locating means includes an actuator movable through the universal joint for releasing the engaging means.

57. A segmented assembly for handling well equipment of the type which is movable through a tubing string for longitudinal engagement with a side pocket recess of a side pocket mandrel comprising:

a. pressure actuated drive means connected with said assembly for driving said assembly through said tubing string in response to pressure applied to said drive means;

b. well equipment handling means connected in said assembly for handling and holding said well equipment;

c. position responsive stopping means in said assembly for automatically stopping said assembly at a predetermined location relative to a selected side pocket recess;

d. orienting means in said assembly for circumferentially orienting said assembly at a predetermined position relative to said side pocket recess; and e. flexible joint means connecting one end of said handling means to said stopping means and the other end of said handling means to said orienting means whereby said assembly may flex to move through curved sections of said tubing string.

58. An assembly as defined in claim 57 wherein said handling means includes retrieving means for attaching to well equipment landed in a side pocket recess and withdrawing said attached equipment as said assembly is moved through the tubing string.

59. An assembly as defined in claim 57 wherein:

a. said stopping means includes spring loaded latch means biased radially outwardly from said assembly and adapted to spring outwardly into a tubing string locating recess having a predetermined configuration for stopping axial movement of said assembly; and b. said orienting means includes inclined guiding surfaces on said assembly adapted to engage and slide against inclined guiding surfaces carried by said tubing string for rotating said assembly, prior to reaching said predetermined location, into a predetermined position relative to the opening in said selected side pocket recess.

60. An assembly as defined in claim 57 wherein said drive means, said stopping means, said equipment handling means and said orienting means are each separate segments having flexible joint means provided between adjacent segments whereby said assembly may flex as it moves through curved sections of tubing.

61. An assembly as defined in claim 57 wherein said handling means includes landing means for carrying well equipment through the tubing string and landing and then releasing said well equipment in a side pocket recess.

62. An assembly as defined in claim 61 wherein said handling means includes retrieving means for attaching to well equipment landed in a side pocket recess and withdrawing said attached equipment as said assembly is moved through the tubing string.

63. An assembly as defined in claim 62 wherein said handling means includes relatively movable components operable by pressure acting in said tubing to move said well equipment from an initial position in said assembly to a second position wherein the bottom of said equipment is positioned over the opening of a selected side pocket recess, said components including a releasable holding mechanism operable by pressure acting in said tubing to land said well equipment in said selected side pocket recess.

64. An assembly as defined in claim 63 wherein said mechanism includes pressure actuated means for engaging and holding well equipment landed in said selected recess.

65. An assembly as defined in claim 61 further including safety lock means preventing relative longitudinal movement of components of said handling means and preventing release of said well equipment by said handling means until said assembly is stopped at said predetermined location.

66. An assembly as defined in claim 65 wherein:

a. said safety lock means includes a self erecting, bendable support means held in a first position on said assembly by said stopping means until said predetermined location is reached;

b. said support means is movable after reaching said predetermined location to a second position on said assembly; and c. flexible means are included in said support means for permitting said support means and said assembly to flex when said support means is at said first or second positions.

67. An assembly as defined in claim 66 wherein:

a. said stopping means includes spring loaded latch means biased radially outwardly from said assembly and adapted to spring outwardly into a tubing string locating recess having a predetermined configuration for stopping axial movement of said assembly; and b. said orienting means includes inclined guiding surfaces on said assembly adapted to engage and slide against inclined guiding surfaces carried by said tubing string for rotating said assembly, prior to reaching said predetermined location, into a predetermined position relative to the opening in said selected side pocket recess.

68. An assembly as defined in claim 61 wherein said handling means includes relatively movable components operable by pressure acting in said tubing to move said well equipment from an initial position in said assembly to a second position wherein the bottom of said equipment is positioned over the opening of a selected side pocket recess, said components including a releasable holding mechanism operable by pressure acting in said tubing to land said well equipment in said selected side pocket recess.

69. A segment running tool for through-the-flowline retrieval or placement of gas lift valves designed for use in the landing recess of a selected side pocket mandrel comprising:

a. pressure drive means responsive to pressure in the flowline to move said tool between the flowline surface and the selected side pocket mandrel;

b. location responsive stopping means connected with said drive means for stopping longitudinal tool movement through the flowline at a predetermined location relative to the landing recess in the selected side pocket mandrel;

c. orienting means connected with said drive means and said stopping means for orienting at least a portion of said assembly at a predetermined position relative to said landing recess;

d. valve handling means connected with said drive means, stopping means and orienting means for holding a gas lift valve in said assembly as it is moved through said flowline;

e. kickover means included in said handling means for moving a portion of said handling means laterally away from the assembly toward said landing recess;

f. holding means included in said handling means for moving said valve longitudinally relative to said landing recess; and g. flexible connecting means connecting said drive means, stopping means, orienting means and handling means into said assembly whereby said assembly may flex along its length as required for movement through curved sections of the flowline.

70. An assembly as defined in claim 69 wherein:

a. said handling means includes release means for landing said valve in said recess; and b. said holding means includes release means for releasing said valve from said assembly following landing of said valve in said recess.

71. An assembly as defined in claim 70 further including safety lock means connected with said stopping means for preventing release of said valve until said assembly is stopped by said stopping means.

72. An assembly as defined in claim 69 wherein said holding means includes attachment means for attaching to said valve while said valve is in landed position whereby said valve may be retrieved at the flowline surface.

73. An assembly as defined in claim 69 wherein said flexible connecting means include means for preventing relative pivotal movement between connected segments while permitting relative pivoted movement between said segments.

74. An assembly as defined in claim 69 further including safety lock means for preventing said valve movement relative to said recess until said assembly is stopped by said stopping means.

* * * * *

UNITED STATES PATENT AND TRADEMARK OFFICE

CERTIFICATE OF CORRECTION

PATENT NO. : 4,294,313

DATED : October 13, 1981

INVENTOR(S) : Harry E. Schwegman

It is certified that error appears in the above—identified patent and that said Letters Patent is hereby corrected as shown below:

Column 6, lines 58-59, for "tool carrier" read --pivot arm--.

Column 8, line 13, before the period (.) insert --53--.

Column 9, line 51, for "61" read --53c--.

Column 11, line 5, for "positions" read --position--.

Column 13, line 55, for "required" read --repaired--.

Column 13, line 58, for "16" read --17--.

Claim 16, line 12, for "retraced" read --retracted--.

Claim 43, line 11, for "oriented" read --orienting--.

Claim 50, line 3, for "hold" read --hole--.

Claim 69, line 1, for "segment" read --segmented--.

Signed and Sealed this

*Fourteenth* Day of *September 1982*

[SEAL]

*Attest:*

GERALD J. MOSSINGHOFF

*Attesting Officer*

*Commissioner of Patents and Trademarks*